US005227595A

United States Patent [19]

Sorenson et al.

[11] Patent Number: 5,227,595

[45] Date of Patent: Jul. 13, 1993

[54] ROTARY SWITCH WITH COMMON CONTACT TERMINAL

[75] Inventors: Richard W. Sorenson; Milton Ives, both of Stuart, Fla.

[73] Assignee: Carlingswitch, Inc., Plainville, Conn.

[21] Appl. No.: 886,435

[22] Filed: May 20, 1992

[51] Int. Cl.[5] ..... H01H 19/58; H01H 21/76

[52] U.S. Cl. ..... 200/11 J; 200/11 K

[58] Field of Search ..... 200/11 R, 11 A, 11 EA, 200/11 E, 11 J, 11 K, 8 R, 8 A, DIG. 29, 277

[56] References Cited

U.S. PATENT DOCUMENTS 4,527,023 7/1985 Ohashi et al. ..... 200/11 G
4,742,187 5/1988 Sorenson ..... 200/11 J
4,748,297 5/1988 Sorenson et al. ..... 200/11 J

*Primary Examiner*—J. R. Scott

*Attorney, Agent, or Firm*—McCormick, Paulding & Huber

[57] ABSTRACT

A miniature rotary switch has nested terminals in its bottom wall and a spherical shaped movable contact arranged in a rotatable control member such that a lower portion of the ball rides over upwardly projecting portions of a common contact ring that is nested in the lower portion of a cavity defined in the switch housing or body portion. One of the terminals is staked to the contact ring to provide an OFF position while the other circumaxially spaced positions are defined by U-shaped cut outs in the contact ring that cause the ball to seat between the edges of each U-shaped cut out and the upper end of a fixed contact terminal provided in the semi-circular cut-out area defined by the common contact ring. The ring is so formed that the ball is releasably retained in each switch position and is biased toward such ON positions when not so retained.

5 Claims, 6 Drawing Sheets

ROTARY SWITCH WITH COMMON CONTACT TERMINAL

BACKGROUND OF THE INVENTION

In prior art U.S. Pat. No. 4,742,187 issued May 3, 1988 a rotary switch is disclosed having a common contact of tubular configuration with a plurality of circumaxially spaced openings for receiving a spherical ball element, the ball element achieving selective contact with each of several fixed contacts provided in circumaxially spaced relationship in the bottom wall of the generally cylindrically shaped cavity provided in the housing. The operating member defines a single recess for receiving the biasing means that urges the spherical element downwardly against the fixed contacts and radially inwardly against the tubular common contact.

SUMMARY OF THE INVENTION

In accordance with the present invention the above-identified tubular common contact is replaced with an annular common contact that is designed to achieve improved electrical contract between the common contact and each of the fixed contact. The downward force on the spherically shaped movable contact element is more efficiently utilized to provide the force required to make positive contact between the fixed contact and the common contact.

In prior art U.S. Pat. No. 4,742,187, the spherical contact element was urged downwardly toward the fixed contact by the full force of the biasing means but only a small component of that force was utilized to urge the spherical ball element into contact with the tubular common contact.

This invention relates generally to rotary switches, and deals more particularly with a rotary switch of the miniature type having a plurality of circumaxially spaced electrical connection terminals nested in a unique pattern at one end. The other end comprises a control member which may be such as to receive a conventional key, or may instead comprise some sort of knob for rotating the operating member.

The body portion or housing defines an upwardly open cavity for receiving the generally cylindrically shaped control member. The circumaxially spaced connection terminals each have upper ends provided in the bottom wall of the cavity and uniformly spaced from one another between the central axis of the cavity and the generally cylindrical cavity wall. Means is provided for restraining the control member from movement axially in the cavity. The control member is provided with a downwardly open recess that is spaced radially from the axis a distance corresponding generally to the radial spacing of the fixed contact upper ends. A spherically shaped movable contact element is provided in the recess and is spring biased downwardly toward the bottom wall of the cavity so as to engage the upper ends of the fixed contacts.

A common contact of annular shape is provided with an inner peripheral edge that in turn defines inwardly projecting portions arranged between the fixed contact upper ends. These projecting portions define U-shaped recesses for receiving the spherically shaped movable contact element in order to provide a generally arc shaped line of contact therewith. The downwardly biased spherically shaped movable contact element serves to provide electrical contact between the common contact and each of the circumaxially spaced upper ends of the fixed terminals.

The generally cylindrical wall surface of the housing cavity defines circumaxially spaced radially inwardly projecting camming lobes which act on the spherically shaped movable contact element between each of the several stable circumaxially spaced positions that the operating member assumes in making contact with each of the circumaxially spaced fixed contact terminals. One of these terminals is staked to the common contact so as to provide a convenient electrical connection to the common contact and hence provide a convenient OFF position for the operating member.

The common contact and more particularly the above mentioned radially inwardly projecting portions thereof are preferably somewhat higher in elevation relative to the bottom wall of the cavity in the housing than is the upper surface of the annular common contact itself. This geometry assures that the spherically shaped movable contact will assume a stable position when making contact with each of the fixed contact upper ends, and so that the spherically shaped contact element will not remain at a position intermediate these circumaxially spaced positions for the operating member.

DETAILED DESCRIPTION

The rotary switch of the present invention has many of the same features and advantages afforded by the rotary switch in U.S. Pat. No. 4,742,187. More particularly the plurality of uniquely configured fixed terminals are provided in circumaxially spaced relationship in the housing portion or body portion 16. Each terminal is inclined at approximately 45 degrees to a radial line constructed from the longitudinal central axis of the generally cylindrical body portion 16.

Figure 9:
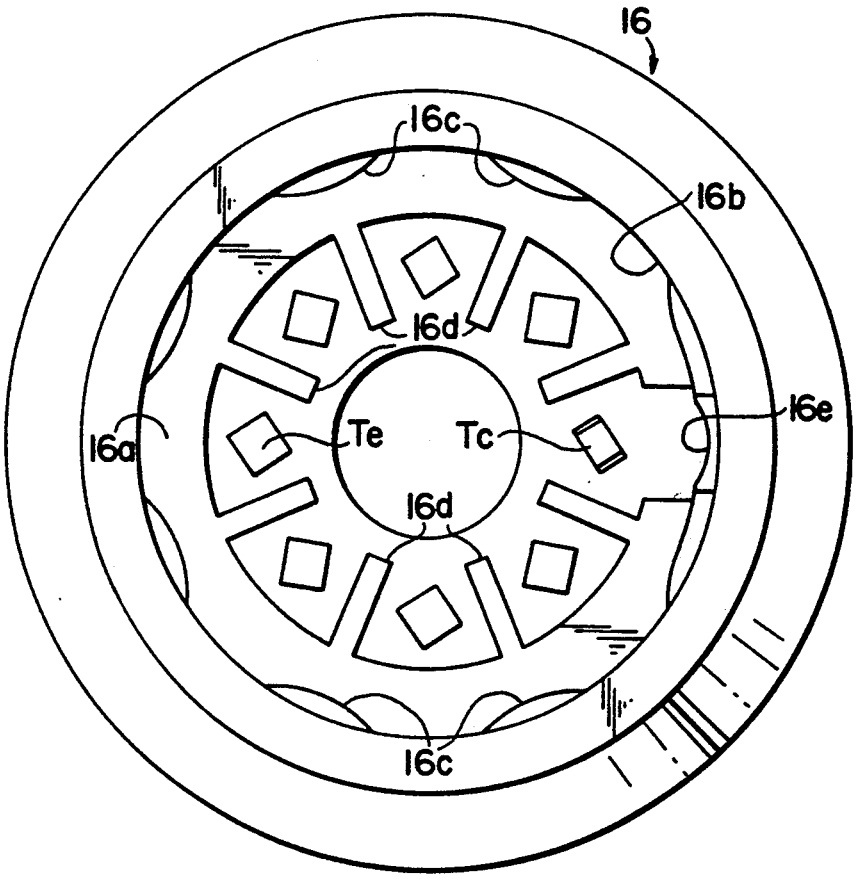
FIG. 9 is a top plan view of the generally cylindrical housing portion body portion of the switch illustrated in FIGS. 1–6 inclusively, but without the control member and without the annular common contact ring.

The body portion 16 has an upwardly open cavity defined by a bottom wall **16*a* and a side wall 16*b*. FIG. 9 shows this bottom wall 16*a* as defining a central opening, and as defining openings for receiving the various circumaxially spaced fixed terminals T, T in FIG. 1**. If desired, barriers may be molded into the base bottom wall as shown, for example, in prior U.S. Pat. No. 4,748,297.

The cylindrical inner wall 16b of the housing 16 also includes radially inwardly protruding projections 16c in FIG. 9, which projections are located adjacent to and between the upper ends of the various fixed terminals T, T. Further, the bottom wall 16a of the housing 16 defines a radially inwardly projecting abutment wall 16d that is oriented in the same radial planes as each of the projections 16c in the side wall 16b.

The prior patent shows stop surfaces defined in the bottom wall of the housing cavity. According to the present invention we provide for such stop surfaces adjacent the upper end of the housing side wall 16b so that a portion 14a of the control member 14 can engage a portion of the housing 15 side wall 16b (not shown) to prevent angular rotation of the control member 14 beyond some predetermined angular displacement.

The control member or actuator 14 includes at least one downwardly open recess 14b, which recess is of generally cylindrical configuration for receiving a coiled compression spring 24 that acts on a pin 10 also received in this cylindrical bore or recess 14b. As so constructed and arranged the pin 10 has a lower end portion engaging a contact ball or sphere 12, and it is a feature of the present invention that the point of contact between the pin 10 and the ball 12 will always be located radially outwardly of the axis of the recess 14b. In this manner the ball 12 is always urged radially outwardly rather than being urged radially inwardly as was the case in the prior patent.

Figure 7:
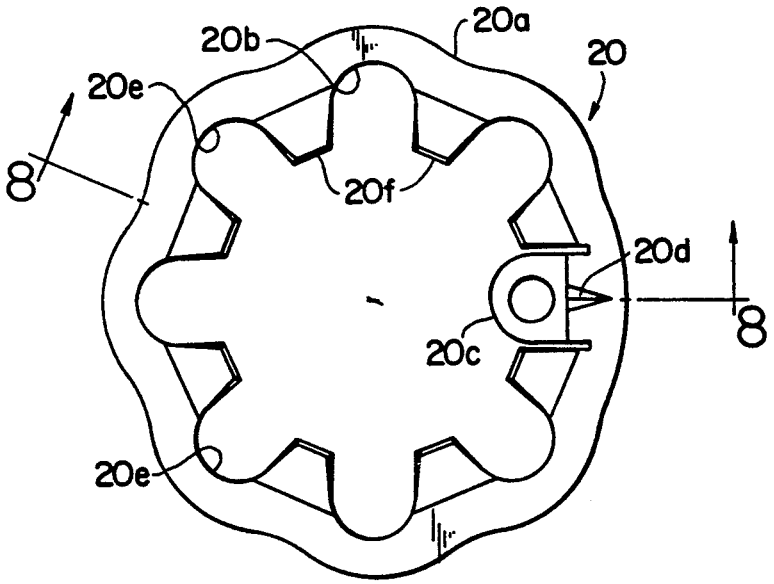
FIG. 7 is a plan view of the common contact illustrated in the previous views.
Figure 8:
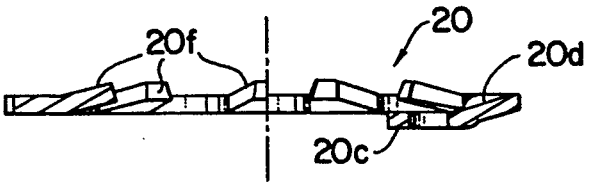
FIG. 8 is a sectional view taken generally on the line 8—8 of FIG. 7.

Also, in contradistinction to the disclosure in the prior patent, the common contact is not so located that the ball 12 must engage such common contact as a result of being biased radially. Instead, the full force of the spring 24 is utilized in providing contact between the ball and an annular common contact 20 located below the ball 12. The configuration of the common contact 20 is best shown in FIG. 7 and 8. As shown in FIG. 7 the common contact 20 has a scalloped shaped outer peripheral edge 20a adapted to be received in a predetermined angular orientation with respect to the housing by reason of the fact that the scalloped outer edge 20a of the common contact 20 mate with the projections 16c on the inside wall of the housing 16.

The inner periphery 20b of the contact ring 20 has inwardly and upwardly projecting portions or teeth 20f which define generally circular cut outs 20e as best shown in FIG. 7. The semi-circular cutouts provide a stable position for the movable contact ball 12 as the contact is moved from one position to another in the manner suggested in FIGS. 1-3 inclusively.

Figure 1:
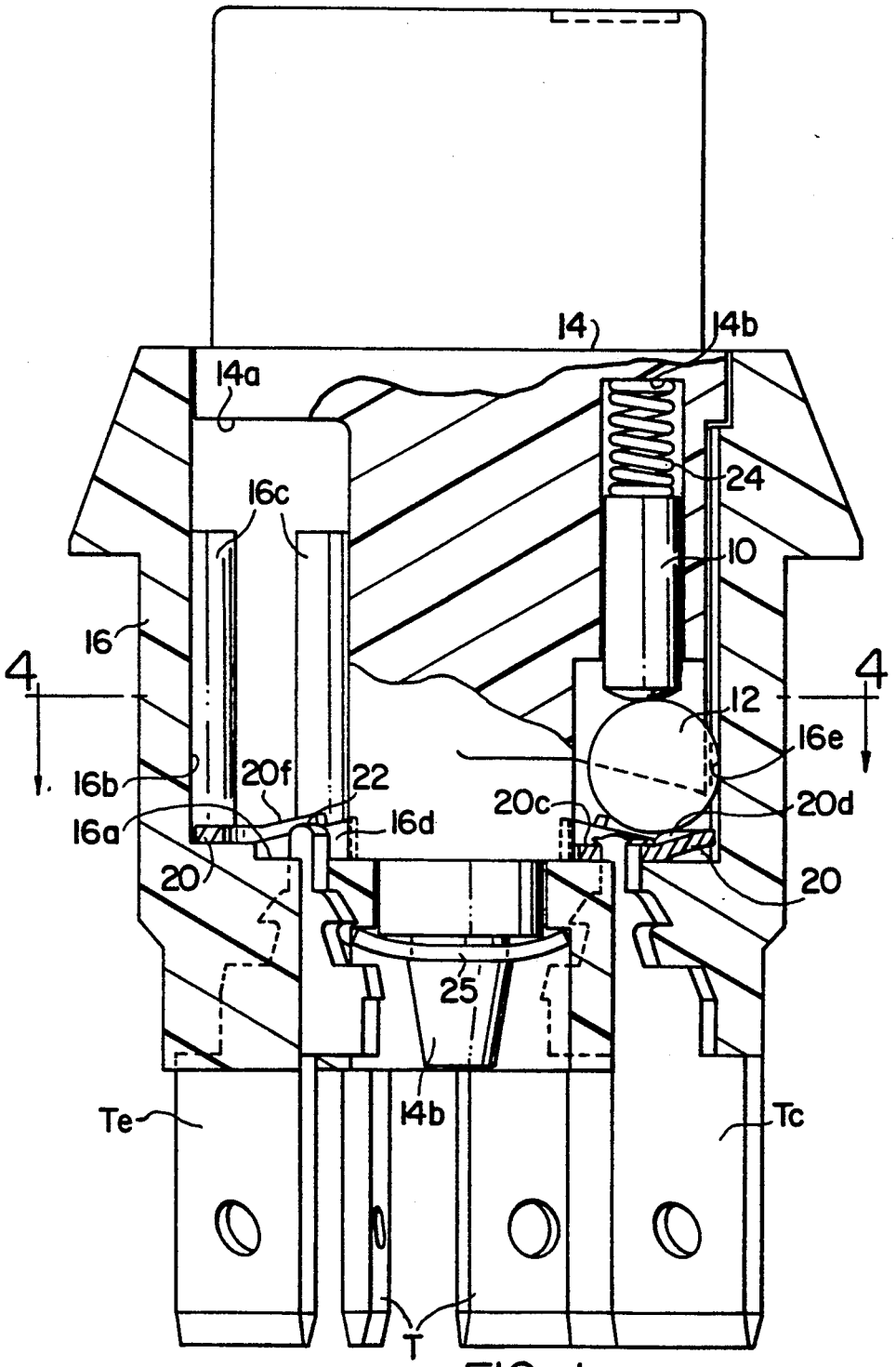
FIG. 1 is a vertical section through a rotary switch equipped with a common contact constructed in accordance with the present invention, the movable contact ball being illustrated in a switch OFF condition.

With particular reference to FIG. 1 the terminal designated generally at Tc has an upper end portion that is staked to the annular contact ring 20 and more particularly to a tab portion 20c provided for this purpose on the inner peripheral edge of the ring 20. As shown in FIG. 7 aligned with this tale portion 20c we provide a detent 20d in the contact ring 20 for receiving and locating the contact ball 12 in the position shown for it in FIG. 1. In this position the contact ball and the contact ring are at the same electrical potential and the switch is electrically OFF.

Figure 3:
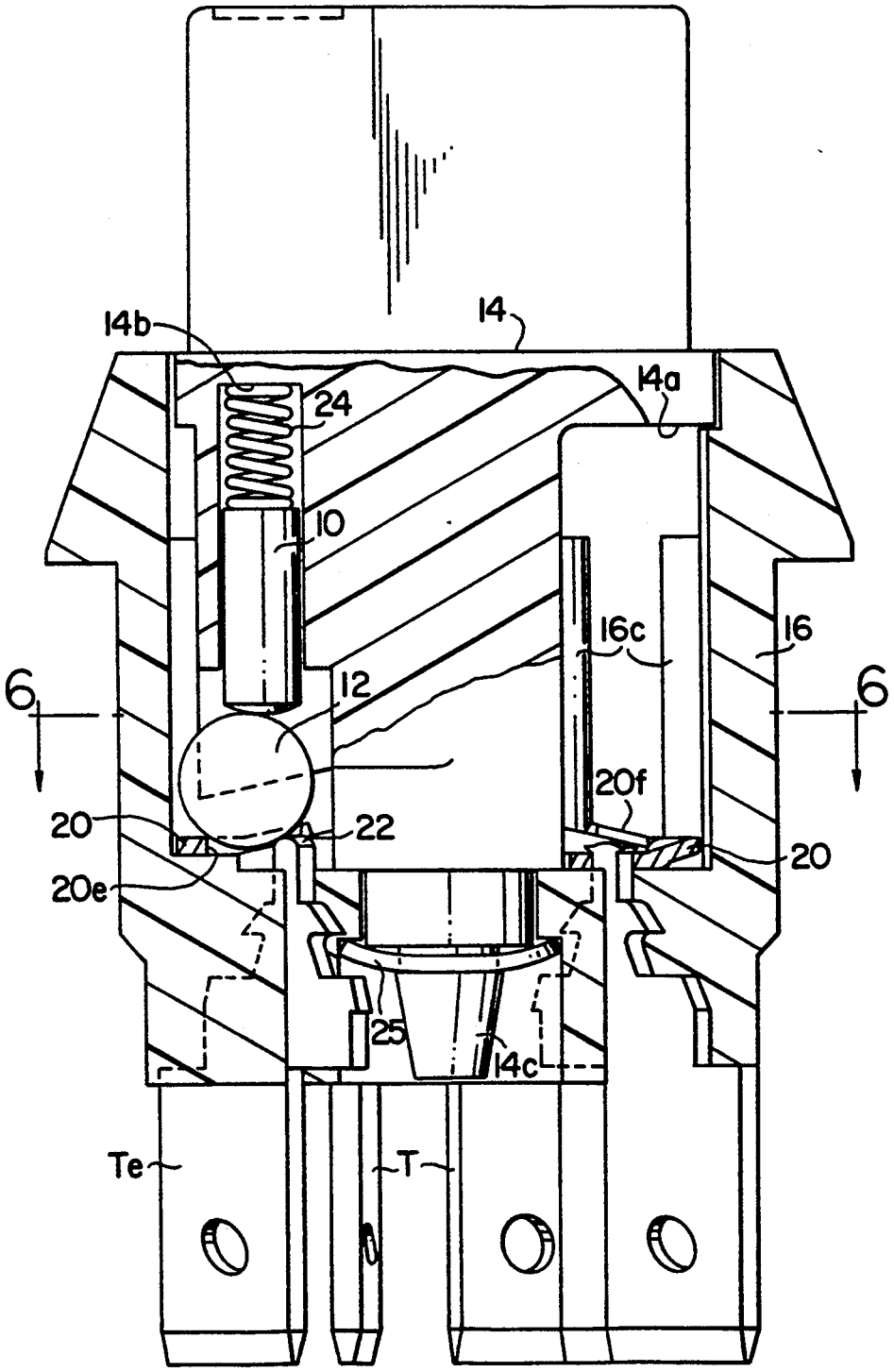
FIG. 3 is a view similar to FIGS. 1 and 2 but showing the ball contact in a stable ON condition.
Figure 6:
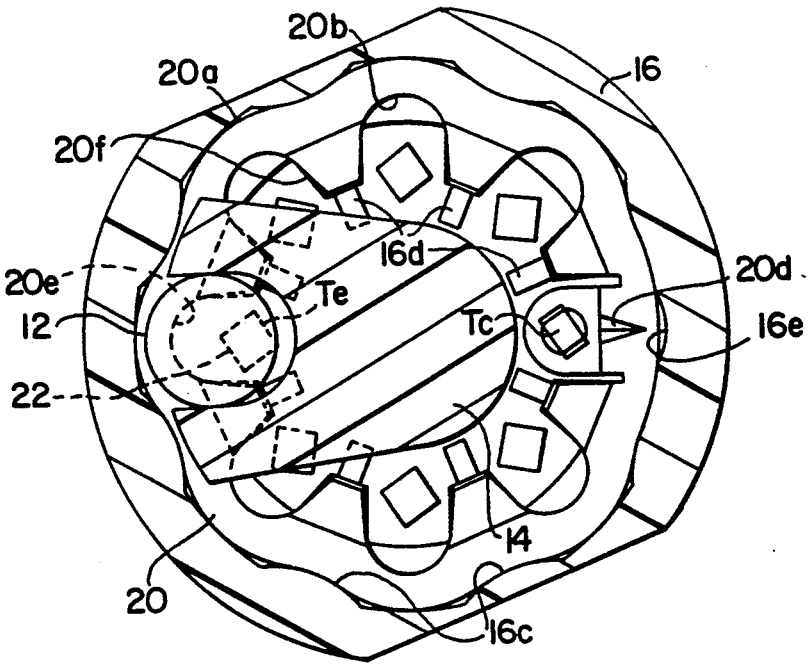
FIG. 6 is a view similar to FIG. 4 but taken generally on the line 6—6 of FIG. 3.

As best shown in FIGS. 3 and 6 the control member has been rotated 180 degrees from that shown in FIG. 1 so that the contact ball 12 is seated in one of the semicircular cut outs 20c of the contact ring 20. In this position the ball 12 affords an electrical contact between the ring 20 and the upper end 22 of the fixed terminal designated Te in FIG. 3. Each of these terminals T, T and Te, Tc are of generally similar geometry except that the last mentioned contact Tc is staked to the common contact ring 20 as described above.

Figure 2:
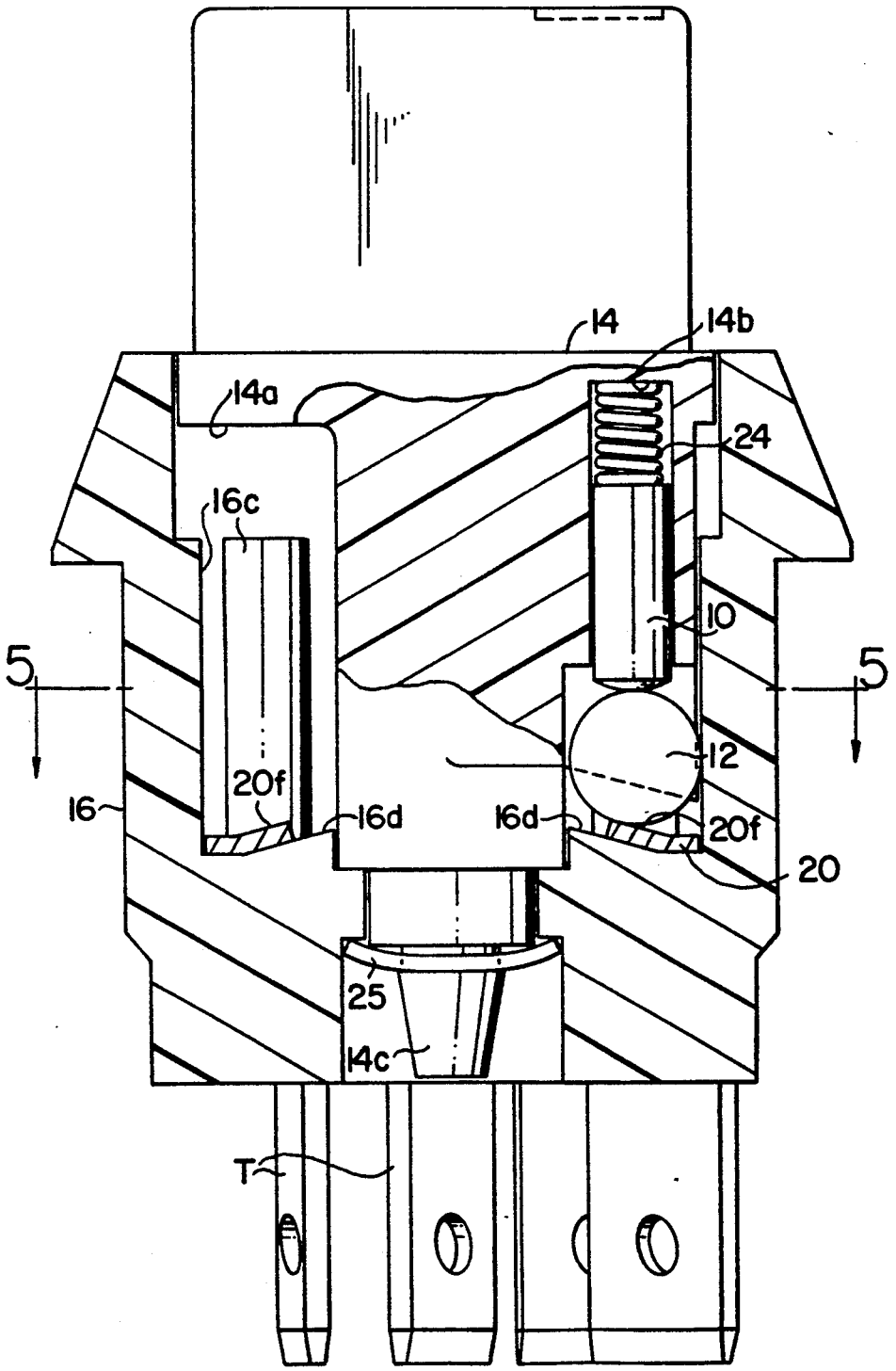
FIG. 2 is a view similar to FIG. 1 but shows the ball contact in a transient position between ON and OFF.

A plurality of switch ON positions are provided in a typical rotary switch and in each position the control member 14 is retained in a stable position in that the ball 12 tends to remain in the position provided for it corresponding to these alternative switch positions. FIG. 2 illustrates the ball 12 in an intermediate and unstable position between two adjacent stable ON positions. More specifically, the annular contact ring 20 is provided with upwardly inclined teeth 20f as best shown in FIGS. 7 and 8 that cause the ball 12 to rise upwardly in order to pass over these teeth 20f as the control member 14 is rotated on the central axis of the housing 16.

Figure 4:
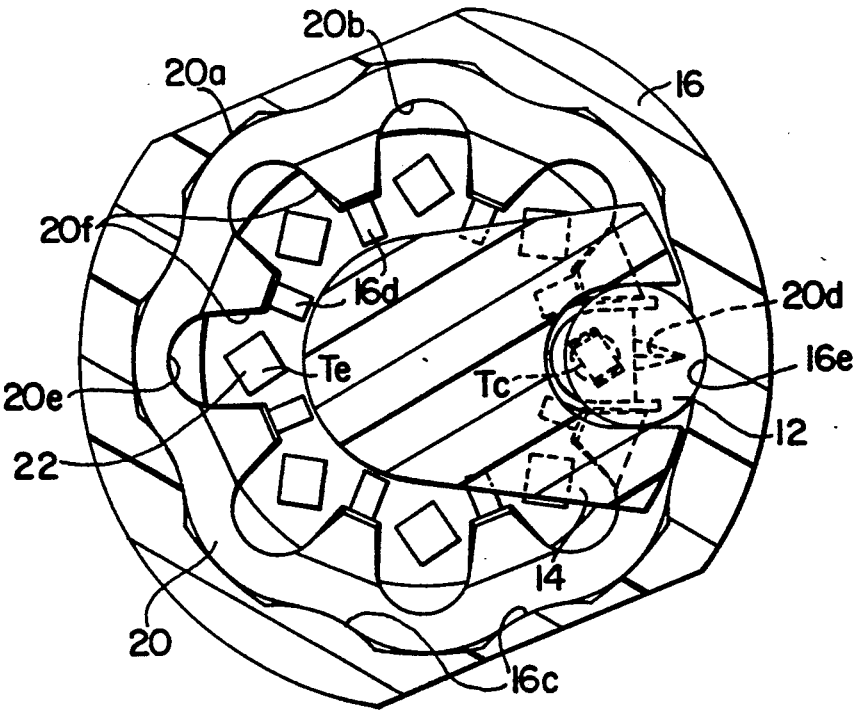
FIG. 4 is a horizontal sectional view taken on the line 5—5 of FIG. 1 showing the ball in the position illustrated in FIG. 1.

FIG. 4 shows the position of the control member 14 and the ball 12 when the switch is OFF, and when the ball 12 is retained by a V-shaped groove 20d in the annular contact ring 20. The ball 12 in this switch OFF position is also located in a small cavity provided for this purpose in the body portion 16. This cavity is indicated generally in FIG. 9 at 16e.

Figure 5:
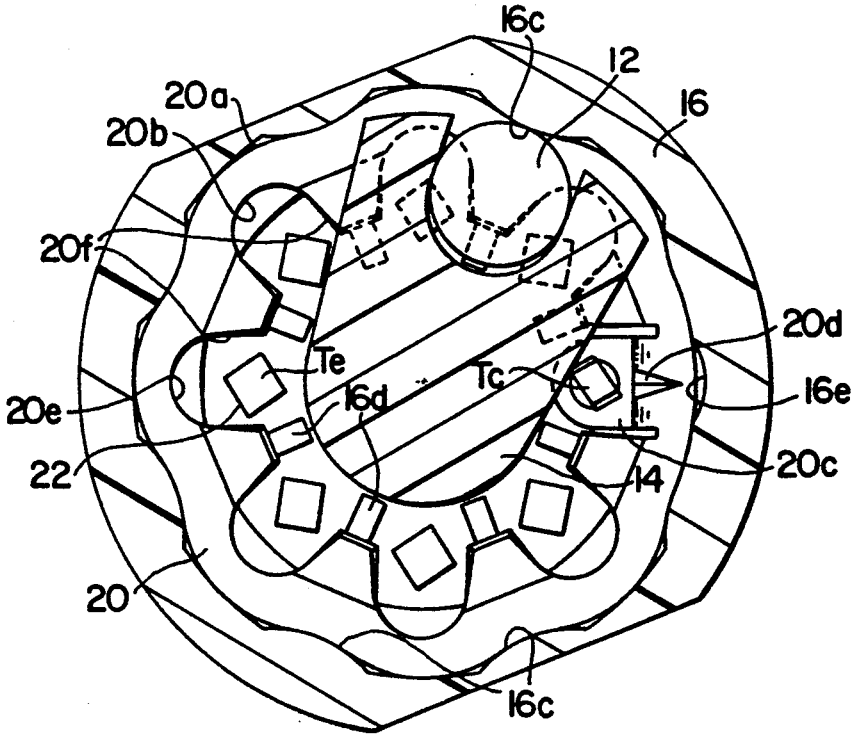
FIG. 5 is a view similar to FIG. 4 but taken on the line 4—4 of FIG. 2.

FIG. 5 shows the control member 14 in an intermediate position corresponding to that depicted in FIG. 2 wherein the ball 12 is located in an unstable intermediate position between two adjacent stable switch positions. In such a position the ball 12 engages one of the projections 16c in the housing so that the ball 12 is biased inwardly and upwardly into an unstable position on top of the tooth 20f of contact ring 20. Thus, the ball 12 will be biased angularly around the axis of the body portion 16 so as to assume a stable switch position for it and the control member 14. FIG. 6 shows the control member 14 in a position corresponding to that depicted in FIG. 3 wherein the switch is in a stable ON position (one of several ON positions provided for in a rotary switch according to the present invention).

As shown in FIG. 6 the ball 12 is provided in a stable switch ON position. The ball 12 rests in a semicircular recess 20e defined for it in the annular contact ring 20 as described previously. In this position the ball need not necessarily contact the inside wall of the housing 16, but may instead be supported solely by the contact ring cut out 20e and the upper end of the fixed contact 22 referred to previously.

Other features of the rotary switch depicted in the drawings have been borrowed from the disclosure of the aboveidentified prior patent. More particularly, the control member 14 has a lower portion defining a post 14c that is adapted to receive a retaining ring 25. Alternatively, the retaining ring could be similar to that shown in the prior U.S. Pat. No. 4,748,297. It should also be noted that barriers might be molded in the bottom of the housing 16 for isolating the terminals from one another as shown in prior U.S. Pat. No. 4,748,297.

We claim:

1. A rotary switch comprising a generally cylindrical dielectric body portion defining an upwardly open cavity of generally cylindrical shape, said cavity having a longitudinal axis, said body portion having a bottom wall defining a plurality of circumaxially spaced openings, fixed contacts provided in at least some of said openings such that upper ends of said fixed contacts are spaced radially between said cavity axis and the cylindrical cavity wall, a generally cylindrical dielectric control member rotatably received in said cavity, means for restraining said control member from movement axially in said cavity, said control member having a least one downwardly open recess, said recess being spaced radially from said axis a distance corresponding to the radial spacing of said fixed contact upper ends, a spherically shaped movable contact element loosely received in said recess, a common contact connected to one of said fixed contacts and having a generally annular shape with an inner peripheral edge defining radially inwardly projecting portions arranged between said fixed contact upper ends, said projecting portions defining U-shaped bays for receiving said spherically shaped movable contact element in order to provide a generally arc shaped line of contact with said spherically shaped movable contact element, and means biasing said spherically shaped movable contact element downwardly toward said common contact.

2. The rotary switch according to claim 1 wherein said U-shaped bays defining said arc shaped line of contact each have a center of arc radius located generally at the upper ends of said fixed contacts.

3. The rotary switch according to claim 1 wherein said generally cylindrical inner surface of said cavity defines circumaxially spaced radially inwardly projecting camming lobes for acting on said movable contact element, and said means biasing said spherically shaped movable contact element also urging said movable contact element radially outwardly toward said camming lobes.

4. The rotary switch according to claim 2 wherein said means biasing said movable contact element comprises a spring and plunger provided in a bore defined by said control member, said bore having an axis that is offset from the center of arc radius of said U-shaped bays.

5. The rotary switch according to claim 1 wherein said radially inwardly projecting portions of said common contact are upturned so as to reside in a plane located above the plane defined by the upper surface of said annular common contact.

* * * * *